United States Patent [19]

Korenowski

[11] 4,197,913

[45] Apr. 15, 1980

[54] USE OF PHOSPHOGYPSUM FOR FIRE SUPPRESSION

[75] Inventor: Theodore F. Korenowski, Branford, Conn.

[73] Assignee: Olin Corporation, New Haven, Conn.

[21] Appl. No.: 922,959

[22] Filed: Jul. 10, 1978

[51] Int. Cl.[2] ..... A62C 3/02; A62C 1/08

[52] U.S. Cl. ..... 169/45; 106/18.14; 169/46; 252/2; 252/8.1; 427/427

[58] Field of Search ..... 252/2, 8.1; 106/18.14; 169/45, 46

[56] References Cited

U.S. PATENT DOCUMENTS

| | | | |
|---|---|---|---|
| 1,421,527 | 7/1922 | Miller | 252/7 |
| 1,612,014 | 12/1926 | Eichengrun | 252/8.1 |
| 3,196,108 | 7/1965 | Nelson | 252/2 |
| 3,730,890 | 5/1973 | Nelson | 252/7 |
| 3,983,040 | 9/1976 | Draganov | 252/2 |
| 4,076,862 | 2/1978 | Kobeski et al. | 252/2 X |
| 4,101,485 | 7/1978 | Brooks et al. | 252/2 |

FOREIGN PATENT DOCUMENTS

| | | | |
|---|---|---|---|
| 666492 | 7/1963 | Canada | 252/2 |

OTHER PUBLICATIONS

Reppert, Chem. Abstracts, vol. 56, p. 15860g.

*Primary Examiner*—Leland A. Sebastian

*Attorney, Agent, or Firm*—William A. Simons; Thomas P. O'Day

[57] ABSTRACT

Particulate gypsum, including phosphogypsum, is used for fire suppression in high fire risk areas such as forests, road sides and areas near railroad lines.

10 Claims, No Drawings

USE OF PHOSPHOGYPSUM FOR FIRE SUPPRESSION

BACKGROUND OF THE INVENTION

1. Field of the Invention

The present invention relates to the employment of gypsum, preferably phosphogypsum, in the suppression of fires.

2. Description of the Prior Art

Large quantities of phosphogypsum are being produced today as a by-product in wet process phosphoric acid plants. In the United States, however, the widespread availability of natural gypsum and its relatively low cost make any large-scale application of phosphogypsum unlikely for the immediate future. Moreover, the cost of transporting phosphogypsum, usually from phosphoric acid plants, remotely located to industrial centers, is generally more expensive than that of nearby natural gypsum. Still further, in many instances, the by-product phosphogypsum requires some purification to remove fluoride and phosphorus before it is suitable for most industrial applications.

A need, therefore, exists today to discover new uses for phosphogypsum (and gypsum), so that total cost of producing phosphoric acid may be lowered and the storage problems associated with the accumulations of the phosphogypsum may be alleviated. Specifically, in the past it has been proposed that phosphogypsum may be employed directly as a setting regulator in cement or plaster or as a soil conditioner. With some purification, it has also been proposed that the by-product phosphogypsum may be converted into gypsum whereby it could be used in industrial or building products such as cement, plaster, wallboard, and the like. However, the demand for unpurified phosphogypsum as a setting regulator or soil conditioner has not kept pace with the increasing supply. Moreover, the purification of phosphogypsum to gypsum usually is too expensive to make the resulting products economically attractive. Therefore, a great need exists for discovering new uses for phosphogypsum which are commercially acceptable.

BRIEF SUMMARY OF THE INVENTION

The present invention comprises the use of gypsum, preferably phosphogypsum, in particulate form for the suppression of fires. An effective amount of particulate phosphogypsum or gypsum may be applied to environments containing inflammable materials such as forests, shrubbery, grass, beside road sides, and next to railroad lines in order to suppress fires. The phosphogypsum or gypsum may be applied alone, or in combination with other fire-fighting materials such as water and clays.

DETAILED DESCRIPTION

The term "gypsum" as employed herein in the present specification and claims includes any hydrated form of $CaSO_4$ such as the usually occurring dihydrate form —$CaSO_4.2H_2O$; the semi-hydrate form —$CaSO_4.\frac{1}{2}H_2O$ and the hexa-hydrate form $CaSO_4.6H_2O$. Gypsum also includes all forms of naturally occurring gypsum and all unpurified and purified forms of phosphogypsum. The term "phosphogypsum" as employed herein refers to any hydrated form of $CaSO_4$ which was formed as a by-product in the production of wet process phosphoric acid by any conventional process. "Phosphogypsum" as referred to herein also includes minor amounts (i.e., less than 50% by weight) of phosphorus-containing compounds such as phosphates and the like. "Particulate phosphogypsum" and "particulate gypsum" referred to herein include forms of these materials in both solid mixtures and liquid, preferably aqueous, slurries and suspensions. The term "particulate" as referred to herein includes loose masses of gypsum material and does not include binded masses of gypsum such as wall board and the like.

When phosphogypsum or gypsum is heated, it releases some or all of the waters of hydration associated with the $CaSO_4$. This effects a consumption of energy from the heat source and provides freed water vapor. These characteristics make phosphogypsum and gypsum advantageous for use in fire suppression. These substances could be employed as a dry powder, a slurry, or suspension in some liquid such as $H_2O$, a blend with other compounds, or in other manners known in the fire-fighting art. An effective amount of phosphogypsum or gypsum would vary with each application and would depend upon many individual factors such as the method of application, materials which are inflammable, other fire-suppression compounds being employed, and the like. Therefore, no definite range may be given for what is an effective amount of phosphogypsum or gypsum in order to suppress fires.

Any conventional method of applying solid or liquid fire-fighting materials to fires and areas where fires may occur may be employed to carry out the present invention. For example, it may be preferable to shovel or otherwise spread (e.g., by means of a fertilizer spreader) the particulate phosphogypsum or gypsum in areas where grass, brush or shrubbery fires are likely to occur, such as near roadways and by railroad lines. In fighting forest fires, it may be preferable to apply the particulate phosphogypsum or gypsum by aerial means such as aircraft and the like. Moreover, the methods of application for the present invention include both the application of either phosphogypsum or gypsum alone, in combination with each other, or in combination with other conventional fire suppression materials like water, clays and the like.

Inflammable materials and their surrounding environment which may be treated according to the present invention are normally the same that could be also treated with other relatively-inert materials such as water, clays and the like.

Gypsum or phosphogypsum may provide benefits beyond fire suppression when used for brush, grass, or forest-type fires. In such cases, the majority of phosphogypsum or gypsum applied to the fire would be converted to calcium sulfate semi-hydrate $CaSO_4.\frac{1}{2}H_2O$ which could act as a binder for soils when water is applied. This could help to reduce erosion and mud slides which often occur on lands that have been defoliated by fire. Also, the gypsum and heat-produced derivatives thereof would serve as a sulfur and calcium source for new plant growth. Furthermore, phosphogypsum contains phosphate compounds which would also act as a fire retardant and aid new plant growth.

The following examples are given to further illustrate the present invention. All parts and percentages are by weight unless otherwise explicitly stated.

EXAMPLE I

Excelsior, i.e., flammable wood shavings, was used in tests to demonstrate the effects of phosphogyspum treatment in reducing flammability and controlling the extent of combustion. In this work, 7×11.5×1.75 inch metal trays were loosely packed with excelsior to form beds that could be conveniently treated, dried, and subjected to ignition tests without being removed from the trays. Separate beds containing 25 grams of excelsior were sprayed with 500 ml of aqueous slurries containing 10, 30 and 50 percent by weight phosphogypsum. Each slurry also contained 20 grams per liter of attapulgite clay (Min-U-Gel® 200, a product of the Floridin Company of Berkeley Springs, West Virginia) and 4 ml per liter concentrated ammonium hydroxide to adjust the pH of each slurry into the range of 9 to 10. Water comprised the balance of each slurry formulation. After being sprayed with slurry, the excelsior beds along with an untreated control were dried for 24 hours at 37° C. and 27% relative humidity. To test flammability, a propane torch flame was applied directly to the surface of each bed for 15 seconds. The untreated control sample ignited immediately and burned to an ash that was about 4 percent of the original sample weight. The excelsior bed treated with a 10 percent phosphogypsum slurry ignited, burned slowly and finally extinguished itself with only 66.4 percent of the excelsior bed consumed based on weight loss. The bed treated with the 30 percent slurry ignited but was self-extinguishing with only 49.6 percent of the bed consumed based on weight loss. Excelsior sprayed with 50 percent phosphogypsum refused to sustain ignition and only 5.6 percent of the bed was consumed based on weights taken before and after ignition testing.

EXAMPLE II

A purified form of gypsum was used to repeat the tests described in Example I. This material was made by leaching phosphogypsum with 28 percent by weight sulfuric acid to essentially remove common phosphogypsum impurities like phosphate, fluoride, and acid soluble metal ions. After water washing and drying this acid leached gypsum was used to prepare 10, 30 and 50 percent slurries with the same amount of attapulgite clay and ammonium hydroxide used in Example I. In the same manner and conditions described in Example I, 500 ml portions of these slurries were applied to separate 25 gram beds of excelsior which were then dried for 24 hours at 37° C. and 27% relative humidity. In this case, excelsior beds treated with 10, 30 and 50 percent gypsum slurried respectively showed 31.6, 92.8 and 99.6 percent of excelsior remaining, based on weight changes, after the 15 seconds exposure to a direct propane torch flame.

EXAMPLE III

The rate of combustion of ponderosa pine needles treated with phosphogypsum was studied. Samples of pine needles were placed in 7×10×2 inch open baskets fabricated from 0.25 inch screen wire. When ignited by contact with a propane torch flame, a 40 gram sample of untreated pine needles required 120 seconds for complete combustion in this test stand. Two phosphogypsum slurries of the following composition were tested for their capacity to reduce this rate of combustion:

| | | |
|---|---|---|
| Slurry A | 40% | weight phosphogypsum |
| | 4% | weight attapulgite clay |
| | 56% | weight 1% aqueous solution of carboxymethylcellulose |
| Slurry B | 22% | weight phosphogypsum |
| | 4% | weight attapulgite clay |
| | 74% | weight 1% aqueous solution of carboxymethylcellulose |

The clay in these formulations was present to aid in gypsum suspension and the carboxymethylcellulose improved adherence of the slurries on the pine needles. Slurries A and B were sprayed over separate 40 gram samples of pine needles in burn baskets. The baskets were dried overnight at 56° C. and 16% relative humidity. Based on dry weight, it was found that a 43.5 gram portion of slurry A was retained on the needles while 26.2 grams of slurry B remained on the needles. When ignited by contact with a propane torch flame, the rate of combustion for both samples was much slower than untreated needles with 300 seconds being required for complete combustion for the slurry A treated needles and 354 seconds for those treated with slurry B.

EXAMPLE IV

Fire protection provided by chemical treatment can be further improved by accompanying rainfall which may cause solubilization and removal of fire resistant materials. In the first step to simulate such conditions, 25 gram excelsior beds in 7×10×2 inch open baskets (0.25 in screen wire) were sprayed with 500 ml portion of one of the following phosphogypsum slurries:

| | | |
|---|---|---|
| Slurry C | 50% | weight phosphogypsum |
| | 2% | weight attapulgite clay |
| | 48% | weight 1% aqueous solution of carboxymethylcellulose |
| Slurry D | 30% | weight phosphogypsum |
| | 2% | weight attapulgite clay |
| | 68% | weight 1% aqueous solution of carboxymethylcellulose |

The two, treated excelsior beds were dried overnight at 50° C. and 20% relative humidity and then subjected to two inches of simulated rainfall by direct application of water through a sprinkler head device. These samples were again dried overnight at the above-mentioned conditions. After this, it was found that 228.6 grams of Slurry C remained on the excelsior and 61.8 grams of D was retained. When exposed to a propane torch flame for 15 seconds, a 13.5% weight loss was found for excelsior treated with Slurry C and a 13.2% weight loss for that treated with Slurry D.

What is claimed is:

1. A method of suppressing fires comprising applying an effective amount of a fire suppression composition comprising particulate phosphogypsum to an inflammable material and its surrounding environment to suppress said fire.

2. The method of claim 1 wherein said fire suppression composition comprises an aqueous slurry of said phosphogypsum.

3. The method of claim 1 wherein said fire suppression composition comprises a dry solid mixture of said phosphogypsum.

4. The method of claim 1 wherein said phosphogypsum is applied to said inflammable material when said inflammable material is burning.

5. The method of claim 1 wherein said phosphogypsum is applied to said inflammable material before said inflammable material is burning.

6. The method of claim 1 wherein said inflammable material comprises forests, shrubbery and grass.

7. The method of claim 1 wherein the gypsum portion of said phosphogypsum consists essentially of $CaSo_4 \cdot 2H_2O$.

8. The method of claim 7 wherein said fire suppression composition is applied aerially.

9. The method of claim 7 wherein said fire suppression composition is spread on said inflammable material and its surrounding environment.

10. The method of claim 7 wherein said inflammable material comprises forests, shrubbery, and grass.

* * * * *